US005119868A

United States Patent [19]

Werner

[11] Patent Number: 5,119,868

[45] Date of Patent: Jun. 9, 1992

[54] VENETIAN BLIND WITH A THREE-POSITION TILT ADJUSTMENT

[76] Inventor: John L. Werner, 1495 Seal Way, Seal Beach, Calif. 90740

[21] Appl. No.: 772,558

[22] Filed: Oct. 7, 1991

[51] Int. Cl.[5] ..... E06B 3/48

[52] U.S. Cl. ..... 160/115; 160/177

[58] Field of Search ..... 160/115, 113, 114, 176.1, 160/177, 178.1, 168.1

[56] References Cited

U.S. PATENT DOCUMENTS

| | | | |
|---|---|---|---|
| 2,647,572 | 8/1953 | Biscoe et al. | 160/115 |
| 3,111,164 | 11/1963 | Lombard | 160/115 |
| 4,621,672 | 11/1986 | Hsu | 160/115 |
| 4,657,061 | 4/1987 | Meier | 160/176.1 |
| 4,869,308 | 9/1989 | Chang | 160/115 X |

*Primary Examiner*—David M. Purol
*Attorney, Agent, or Firm*—Willie Krawitz

[57] ABSTRACT

The slats of a venetian blind panel are divided into upper and lower sections, the tilt of the panel slats being separately adjusted for each section, utilizing a three-position switch attached to a rotatable and horizontally movable control rod. Depending upon the position of the switch, the control rod adjusts the tilt of the slats in the upper section only, the lower section only, or both sections together. The mechanism includes at least two spline gears which can adjust the tilt of the slats of the upper and lower panel sections when the control rod is rotated. The control rod is horizontally movable and mounts inner spline gears and engaging outer spline gears. In one position, the inner spline gear engages a first outer spline gear, and upon rotation, will adjust the tilt of the upper blind section. In a second position the inner spline gear engages a second outer spline gear to adjust the tilt of the bottom blind section, and in a third position, the inner spline gear engages both outer spline gears to adjust the tilt of both upper and lower blinds simultaneously.

2 Claims, 2 Drawing Sheets

VENETIAN BLIND WITH A THREE-POSITION TILT ADJUSTMENT

BACKGROUND OF THE INVENTION

This invention relates to a new and improved mechanism for selectively adjusting the tilt of sections of a venetian blind slat array. More specifically, this invention relates to a three-position switch for separately controlling the tilt of the top, bottom and entire array of venetian blind slats.

Various patents describe mechanical systems for controlling the tilt of venetian blind slats, and typical patents in this field are U.S. Pat. Nos. 2,751,000; 2,836,237; 2,839,136; 2,894,574; 2,818,113; 2,849,063; 2,918,121; 3,111,164; 4,621,672; 4,657,061; and, 4,940,070.

However, these control systems tend to be complicated and bulky, and consequently, it is desired to provide a simplified and compact mechanical control system. This will result in a smaller obstruction of the window covered by the venetian blind control. Also, it is desired to provide a mechanical control system which can be easily manipulated and is capable of selectively controlling the tilt of the slats, namely the top, bottom or the entire array.

THE INVENTION:

According to the invention, there is provided a mechanism for controlling the tilt of venetian blind slats, comprising a three-position, horizontally movable and rotatable control rod having mounted thereon inner spline gears. Each inner spline gear operates with a pair of outer spline gears and may rotate either one or both of the outer spline gears. Each of the outer spline gears are adapted to separately tilt the upper or lower sections of the venetian slat array. Also, when operated together, the outer spline gears control the tilt of the entire slat array of the venetian blinds.

When the horizontally movable control rod is moved a sufficient distance, depending on its specific setting, each inner spline gears of the control rod will engage and drive either one or both of the outer spline gears. This enables the user to selectively control the tilt of sections of the venetian blinds with a control which is simply designed, compact, inexpensive, and easy to install and operate.

DESCRIPTION OF THE PREFERRED EMBODIMENTS

Figure 1:
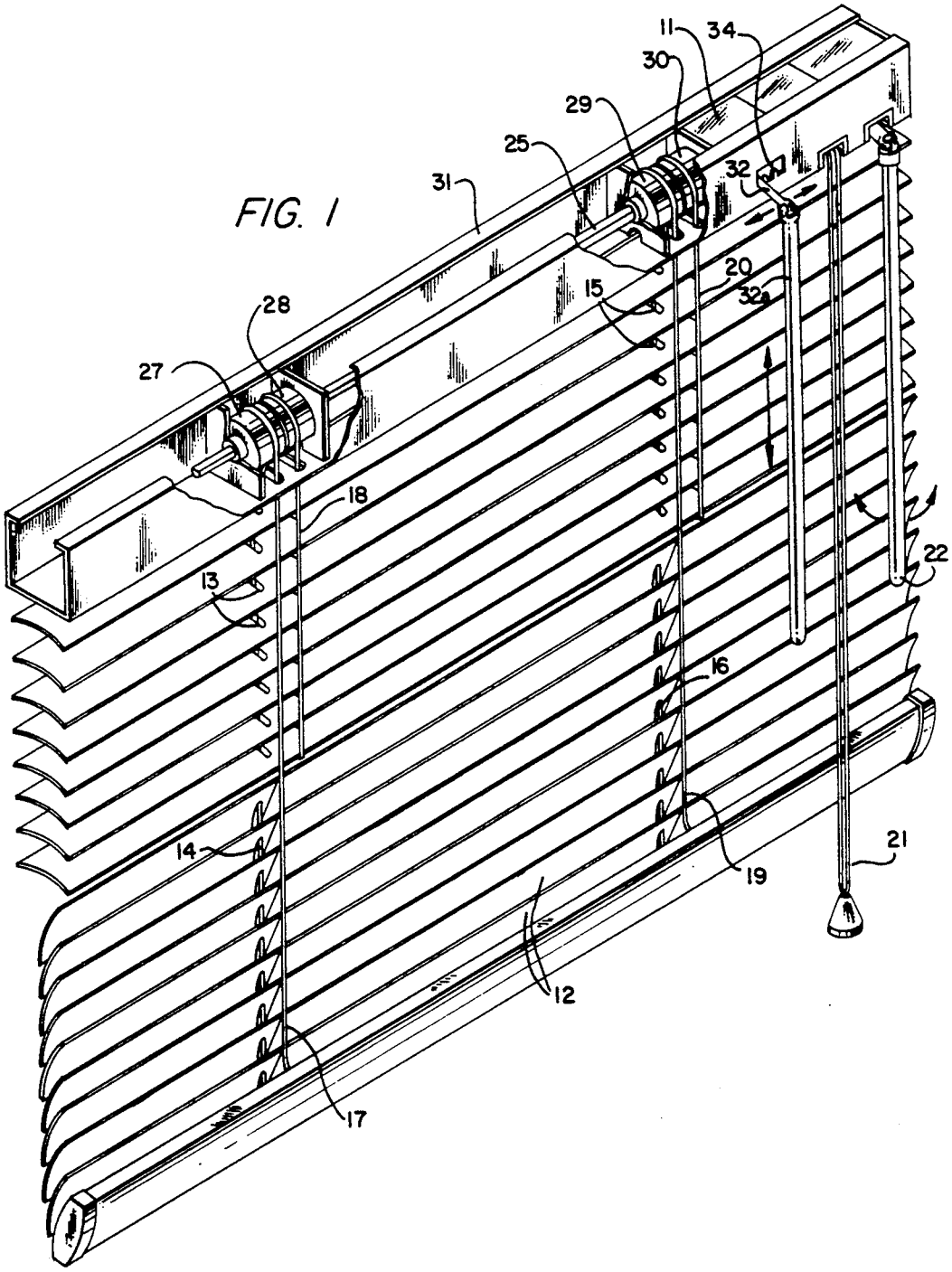
FIG. 1. is an external, perspective view of a venetian blind controlled by the three-position switch of this invention.

A venetian blind 10 suitable for use with a three-position switch 11 of this invention is shown in FIG. 1, and comprises a plurality of venetian blind slats 12 containing a series of slots 13 and 15, through which are passed elevating cords 14 and 16. The venetian blind is raised or lowered by a cord 21 attached to cords 14 and 16. Tilt adjusting cords 17, 18, 19 and 20 function to adjust the tilt of the slats 12, and a rotatable tilt adjustment rod 22 controls the slat tilt through these tilt adjusting cords.

A drive rod 25 is shown in FIGS. 1–5 attached to an inner spline gear 26 (only one being shown) which rotates outer spline gears 27 and 28 to adjust the tilt of the blind slats. Outer spline gears 29 and 30 are similarly rotated, as shown in FIG. 1, and if desired, the gears may be cambered to improve their engagement characteristics. The spline gears are rotatably mounted within a header 31. The drive rod 25 is controlled in its horizontal movement by a switch 32, and an extension arm 32*a*. The switch 32 is attached to the drive rod 25 by means of a mounted bearing race 33. Rotation of the rod 25 is controlled by the rotatable rod 22, and the rod 25 is rotatable within the bearing race 33.

Figure 5:
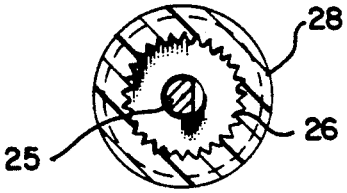

Switch 32 moves on a positioning element 34 having detent slots 35, 36 and 37, and are spaced to provide the necessary incremental distances for movement of drive rod 25 and attached inner spline gear 26 to selectively engage outer spline gears 27 and 28. FIG. 5, shows the inner spline gear 26 engaged with drive rod 25, and engaging the outer spline gear 28.

Figure 2:
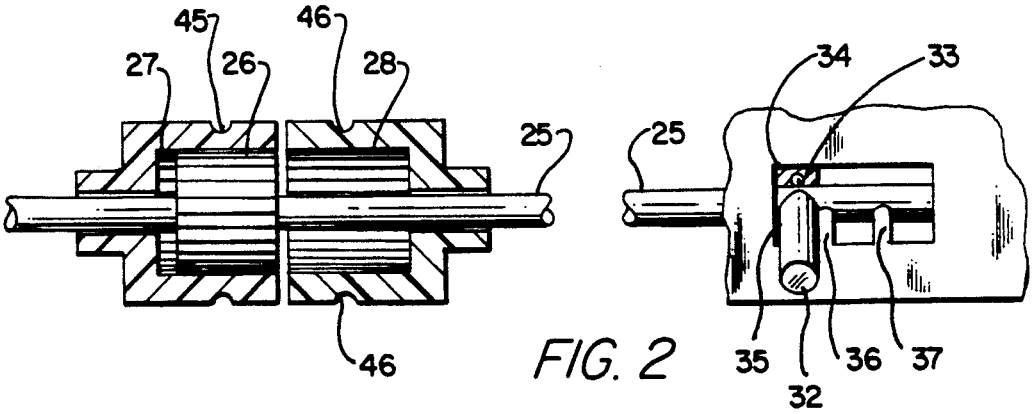
FIG. 2. is a sectional side elevation view showing the control rod in a fully left position, to engage an inner spline gear with one of the outer spline gears for controlling the tilt of the lower section of the venetian blind.

In operation, when the switch lever 32 is recessed in detent slot 35, the attached rod 25 will be in the fully left position, as shown in FIGS. 1 and 2, and inner spline gear 26 will engage only outer spline gear 27. Hence, rotation of drive rod 25 by rotatable rod 22 will rotate gear 27, around which is wrapped tilt adjusting cord 17 in groove 45; this will adjust the tilt of the bottom section of the slats 12. Spline 29 (FIG. 1.) will be similarly rotated to effect a balanced tilt of the slats, using tilt adjusting cord 19.

Figure 3:
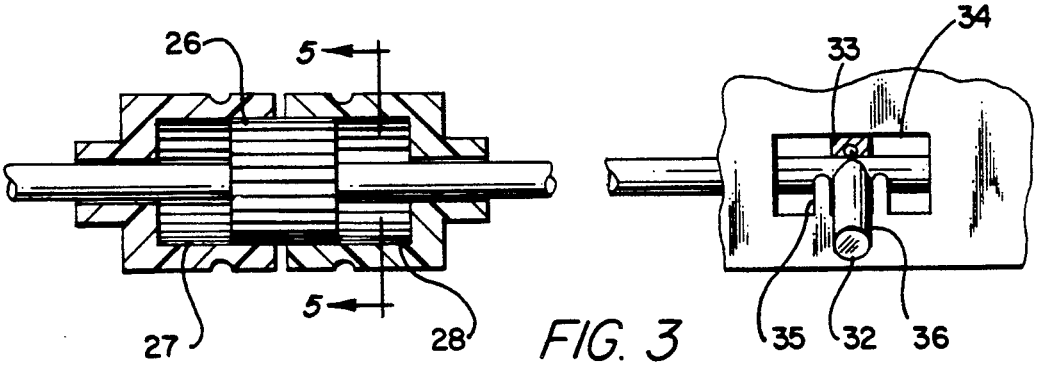
FIG. 3. is a sectional side elevation view showing the control rod in a central position, to engage the inner spline gear and both the outer spline gears for controlling the tilt of both sections of the venetian blind.

Similarly, as shown in FIG. 3, when the drive rod 25 is recessed in detent slot 36, attached rod 25 will be in a central position, and inner spline gear 26 will engage both outer spline gears 27 and 28. Hence, rotation of the drive rod 25 by rotatable rod 22 will rotate gears 27 and 28. Also, another inner spline gear (not shown) will engage outer spline gears 29, 30. Thus, the inner spline gears will operate simultaneously to rotate the outer spline gears 27, 28, 29 and 30 and produce a balanced tilting of the entire array of both the upper and lower slats.

Figure 4:
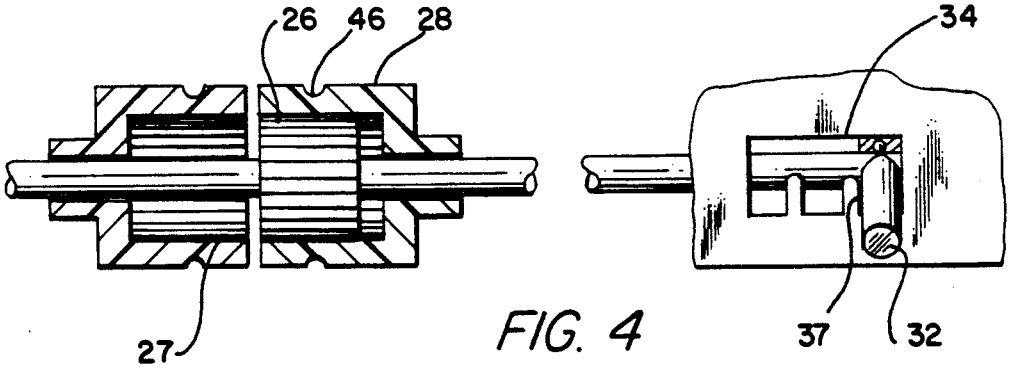
FIG. 4. is a sectional side elevation view showing the control rod in the right position to engage the inner spline gear with an outer spline gear for controlling the tilt of the upper section of the venetian blind; and, FIG. 5. is a sectional view in end elevation taken along lines 5—5 of FIG. 3. showing the control rod mounted to the inner gear.

FIG. 4 illustrates tilting of the upper slats, and for this embodiment, the drive rod 25 is moved horizontally to the right, and switch 32 is recessed into detent slot 37. This will move inner spline gear 26 completely out of engagement with gear 27, and gear 26 will only engage with outer spline gear 28. Hence, rotation of drive rod 25 will rotate the gear 28 around which is wrapped tilt adjusting cord 18 in groove 46. This adjusts the tilt of the upper section of the slats. Spline gear 30 is similarly rotated to effect a balanced tilt of the slats using tilt adjustment cord 20.

The tilt adjustment mechanism of this invention is compact and it will improve the function of venetian blinds without increasing obstruction of an associated window opening. It will be appreciated that for very wide venetian blinds it may be necessary to install more than the two sets of spline gears shown in FIG. 1. Also, other gear drive systems, such as worm gears may be employed instead of spline gears.

I claim:

1. In a venetian blind comprising upper and lower tiltable blind panels, and tilt adjusting cords attached to the panels for producing a tilt action thereto, the improvement of a control system for tilting the upper blind panel, middle blind panel, and entire panel array, comprising:

a.) a rotatable and horizontally movable control rod mounted by the venetian blind, the control rod mounting an inner spline element; and, b.) first and second sets of outer spline elements rotatably mounted upwardly of the venetian blind and engaging the tilt adjusting cords, rotation of the said sets of spline elements causing the cords to change the tilt of the blind panels, the control rod and inner spline element being horizontally moveable for engaging the inner spline element with the said sets of spline elements; whereby, upon horizontal movement and subsequent rotation of the control rod:

i. in a first position, engagement with the first set of outer spline elements with the inner spline element will enable rotation of the cords, and thereby tilt the upper blind panels;

ii. in a second position, horizontal movement of the control rod will completely disengage the inner spline element with the first set of outer spline elements and completely engage the second set of outer spline elements, to enable rotation of the cords, and thereby tilt the lower blind panels; and, iii. in a third position, horizontal movement of the control rod will partially engage both sets of outer spline elements with the inner spline element, to enable rotation of the cords, and thereby tilt the entire panel array.

2. In a venetian blind comprising upper and lower tiltable blind panels and tilt adjusting cords attached to the panels for producing a tilt action thereto, the improvement of a control system for tilting the said panels and the entire panel array, comprising:

a.) a rotatable and movable control rod mounted by the venetian blind, the control rod mounting an inner spline element; and, b.) first and second sets of outer spline elements rotatably mounted upwardly of the venetian blind and engaging the tilt adjusting cords, rotation of the said sets of spline elements causing the cords to change the tilt of the blind panels, the control rod and inner spline element being moveable for engaging the inner spline element with the said set of spline elements; whereby, upon movement and subsequent rotation of the control rod:

i. in a first position, engagement with one set of outer spline elements with the inner spline element will enable rotation of the cords, and thereby tilt the upper or lower blind panels; and, ii. in a second position, movement of the control rod will partially engage both sets of outer spline elements with the inner spline element, to enable rotation of the cords, and thereby tilt the entire panel array.

* * * * *